US010495102B2

(12) United States Patent
Guo et al.

(10) Patent No.: US 10,495,102 B2
(45) Date of Patent: Dec. 3, 2019

(54) IMPELLER AND PUMP USING THE IMPELLER

(71) Applicant: JOHNSON ELECTRIC INTERNATIONAL AG, Murten (CH)

(72) Inventors: Chuan Jiang Guo, Shenzhen (CN); Chuan Hui Fang, Hong Kong (CN); Xiao Liang Zhang, Shenzhen (CN)

(73) Assignee: JOHNSON ELECTRIC INTERNATIONAL AG, Murten (CH)

( * ) Notice: Subject to any disclaimer, the term of this patent is extended or adjusted under 35 U.S.C. 154(b) by 313 days.

(21) Appl. No.: 15/390,065

(22) Filed: Dec. 23, 2016

(65) Prior Publication Data

US 2017/0184116 A1 Jun. 29, 2017

(30) Foreign Application Priority Data

Dec. 23, 2015 (CN) ..... 2015 1 0979898

(51) Int. Cl.
*F04D 29/24* (2006.01)
*F04D 1/08* (2006.01)
(Continued)

(52) U.S. Cl.
CPC ..... *F04D 29/24* (2013.01); *F04D 1/08* (2013.01); *F04D 17/08* (2013.01); *F04D 29/083* (2013.01); *F04D 29/086* (2013.01); *F04D 29/167* (2013.01); *F04D 29/2266* (2013.01); *F04D 29/30* (2013.01); *F04D 29/4233* (2013.01); *F04D 29/4293* (2013.01)

(58) Field of Classification Search
CPC ..... F04D 29/24; F04D 29/086; F04D 29/126; F04D 29/426; F04D 29/22; F04D 17/08; F04D 1/08
See application file for complete search history.

(56) References Cited

U.S. PATENT DOCUMENTS 5,618,168 A * 4/1997 Moon ..... F04D 29/167 415/170.1
7,883,312 B2 * 2/2011 Eguchi ..... F04D 29/162 415/119

(Continued)

FOREIGN PATENT DOCUMENTS

CN 200943599 Y 9/2007

*Primary Examiner* — Dwayne J White
*Assistant Examiner* — Jackson N Gillenwaters
(74) *Attorney, Agent, or Firm* — Muncy, Geissler, Olds & Lowe, P.C.

(57) ABSTRACT

An impeller includes a back cover plate, and vanes and a hub disposed on the back cover plate. The impeller further includes a sealing ring disposed on one end of the impeller away from the back cover plate. A pump using the impeller includes a volute housing and a driving device. The volute housing includes a diffusor chamber, an inlet pipe and an outlet pipe. The impeller is rotatably received in the diffusor chamber and connected to the driving device. A baffle portion is disposed on an end wall in the diffusor chamber adjacent the inlet pipe. The baffle portion engages with the sealing ring to prevent back flow of the fluid. The pump has enhanced fluid delivery efficiency. The back cover plate may further define arc strip-shaped balance holes for reducing an axial force applied to the impeller, such that rotation of the impeller is more stable.

12 Claims, 5 Drawing Sheets

(51) Int. Cl.

| | |
|---|---|
| ***F04D 17/08*** | (2006.01) |
| ***F04D 29/08*** | (2006.01) |
| ***F04D 29/30*** | (2006.01) |
| ***F04D 29/42*** | (2006.01) |
| ***F04D 29/16*** | (2006.01) |
| ***F04D 29/22*** | (2006.01) |

(56) References Cited

U.S. PATENT DOCUMENTS

2014/0369824 A1* 12/2014 Guo ..... F04D 29/445
415/204
2018/0045213 A1* 2/2018 Groppo ..... F04D 1/06

* cited by examiner

IMPELLER AND PUMP USING THE IMPELLER

CROSS REFERENCE TO RELATED APPLICATIONS

This non-provisional patent application claims priority under 35 U.S.C. § 119(a) from Patent Application No. 201510979898.6 filed in The People's Republic of China on Dec. 23, 2015.

FIELD OF THE INVENTION

The present invention relates to an impeller, and in particular, to a centrifugal impeller and a pump using the impeller.

BACKGROUND OF THE INVENTION

A centrifugal pump usually includes a motor which drives an impeller to rotate to create a negative pressure inside the pump, such that liquid is continuously drawn in and propelled out. The impeller is an indispensable component of the pump, and its design and construction directly affects the fluid delivery efficiency of the pump.

In a conventional centrifugal pump, the impeller is mounted within a hollow chamber of the volute housing. A large gap usually exists between the impeller and an end wall of the hollow chamber adjacent an inlet. After the fluid enters the hollow chamber via the inlet and is rotated by the impeller, part of the fluid may flow back into the inlet via the gap, which may cause unstable flow velocity of the fluid and hence poor fluid delivery efficiency of the pump.

SUMMARY OF THE INVENTION

Thus, there is a desire for an impeller with improved efficiency and a pump using the impeller.

An impeller comprises a back cover plate, a plurality of vanes disposed on the back cover plate, and a hub disposed on the back cover plate. The impeller further comprises a sealing ring, the sealing ring disposed on one end of the impeller away from the back cover plate.

Preferably, the back cover plate defines a recess in one side of the back cover plate, and the hub is disposed in the recess of the back cover plate.

Preferably, the back cover plate further defines a plurality of balance holes.

Preferably, the number of the balance holes is the same as the number of the vanes.

Preferably, the plurality of balance holes is arranged into a ring in the back cover plate, and each of the vanes is disposed between two adjacent balance holes.

Preferably, the back cover plate further defines a plurality of through holes arranged into a ring, and the plurality of through holes are spaced from each other and evenly distributed between the ring cooperatively defined by the balance holes and the hub.

Preferably, each of the balance holes is arc-shaped, and a central axis of the ring cooperatively defined by the balance holes is coincident with a central axis of the back cover plate.

Preferably, the vanes extend from start positions adjacent a central axis of the back cover plate toward an edge of the back cover plate.

Preferably, the back cover plate comprises a connecting plate and a support plate, one side of each of the vanes away from the sealing ring is connected to the connecting plate and the support plate, and the hub is disposed on one side of the support plate away from the vanes.

Preferably, the connecting plate is annular, a cross section of the support plate is annular, and an inner diameter of the connecting plate is greater than an outer diameter of the cross section of the support plate.

Preferably, each of the vanes includes a main portion, one end of the main portion is connected to the sealing ring, and the other end is connected to the connecting plate and the support plate.

Preferably, each of the vanes includes a connecting portion projecting from one end of the main portion, and the connecting portion is connected between the connecting plate and the support plate to divide a spacing between the connecting plate and the support plate into a plurality of balance holes.

Preferably, the support plate defines a plurality of through holes arranged into a ring, and the ring cooperatively defined by the plurality of through holes is concentric with the hub.

A pump comprises a volute housing and a driving device. The volute housing comprises a housing body, an inlet pipe and an outlet pipe. The housing body comprises a diffusor chamber, and the inlet pipe and the outlet pipe are in communication with the diffusor chamber. The driving device is connected to the housing body. The pump further comprises an impeller as described above. The impeller is rotatably received in the housing body and connected to the driving device, and the driving device is configured to drive the impeller to rotate.

Preferably, the pump further comprises a baffle portion disposed on an end wall in the diffusor chamber adjacent the inlet pipe.

Preferably, one end of the baffle portion defines an annular engagement groove therein along a circumferential direction of the end, and the sealing ring is rotatably received in the engagement groove.

In the pump of the present invention, the impeller is provided with the sealing ring, and the volute housing is provided with the engagement groove that receives the sealing ring. This changes the way the fluid flows in the diffusor chamber of the volute housing and increases the resistance to the fluid flowing back into the inlet pipe, thereby further optimizing the design of the volute housing and resulting in enhanced fluid delivery efficiency. In addition, the back cover plate of the impeller is provided with the plurality of arc strip-shaped balance holes, which reduces the axial force applied to the impeller and results in more stable rotation of the impeller.

DESCRIPTION OF REFERENCE NUMERALS OF MAIN COMPONENTS

Below, embodiments of the present invention will be described in detail with reference to the accompanying drawings.

DETAILED DESCRIPTION OF THE PREFERRED EMBODIMENTS

The technical solutions of the embodiments of the present invention will be clearly and completely described as follows with reference to the accompanying drawings. Apparently, the embodiments as described below are merely part of, rather than all, embodiments of the present invention. Based on the embodiments of the present disclosure, any other embodiment obtained by a person skilled in the art without paying any creative effort shall fall within the protection scope of the present invention.

It is noted that, when a component is described to be "fixed" to another component, it can be directly fixed to the another component or there may be an intermediate component. When a component is described to be "connected" to another component, it can be directly connected to the another component or there may be an intermediate component. When a component is described to be "disposed" on another component, it can be directly disposed on the another component or there may be an intermediate component. The directional phraseologies such as "perpendicular" or similar expressions are for the purposes of illustration only.

Unless otherwise specified, all technical and scientific terms have the ordinary meaning as understood by people skilled in the art. The terms used in this disclosure are illustrative rather than limiting.

Figure 1:
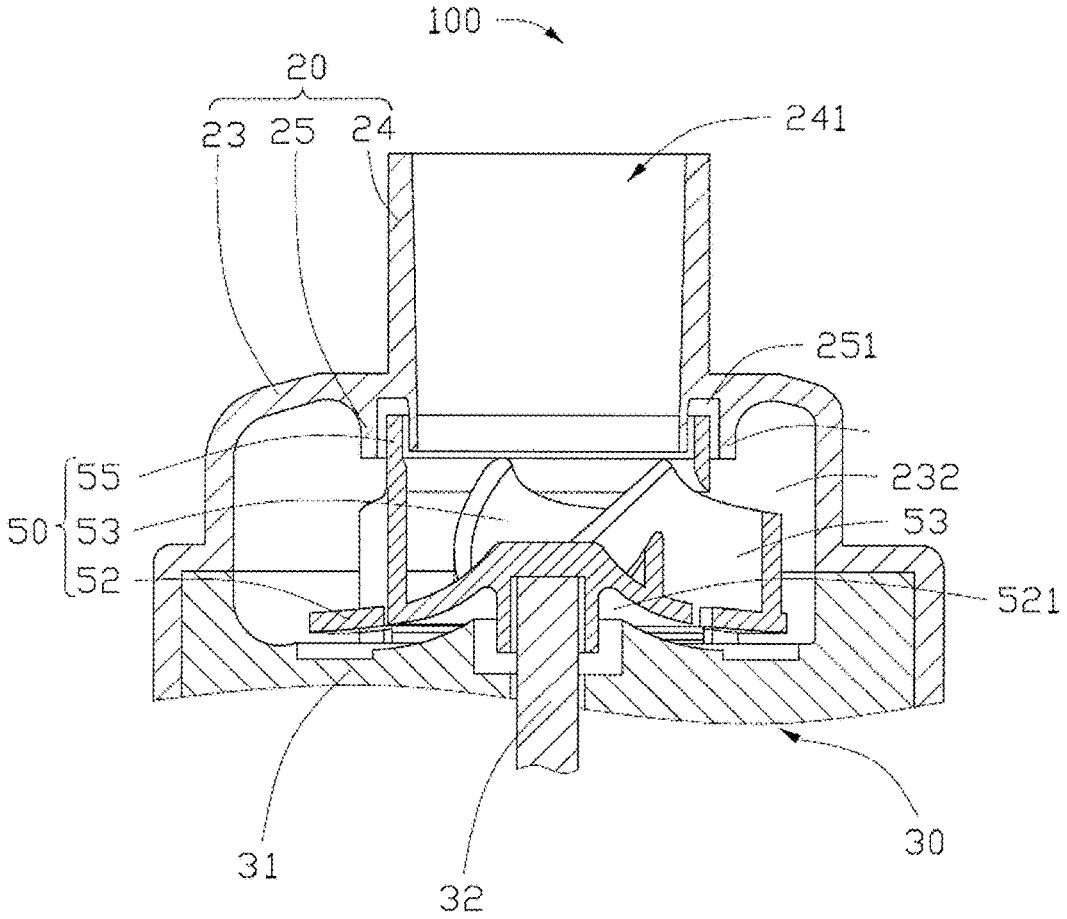
FIG. 1 is a sectional, partial view of a pump according to one embodiment of the present invention.

Referring to FIG. 1, a pump 100 in accordance with one embodiment of the present invention is used to draw a fluid such as air, water or oil so as to deliver the fluid from a container to another container or an outside environment, for example, drain water off a water pool. In this embodiment, the pump 100 is a centrifugal pump which can be used in a washing machine or dishwasher. It should be understood that the pump 100 may also be used to draw or drain a flowable fluid such as gas.

Figure 4:
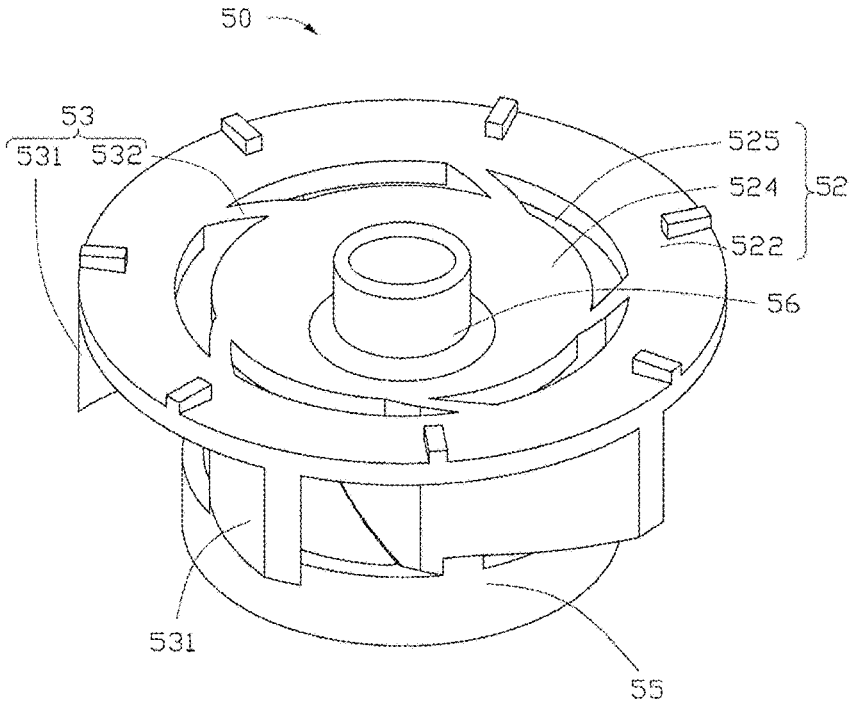
FIG. 4 is a sectional view of the impeller of FIG. 2, taken along line IV-IV thereof.

Referring to FIG. 1 and FIG. 4, the pump 100 includes a volute housing 20, a driving device 30 (partially shown in FIG. 1), and an impeller 50. The volute housing 20 is connected to the driving device 30, and the impeller 50 is rotatably received in the volute housing 20. The impeller 50 rotates under the driving of the driving device 30 to thereby draw and drain the fluid.

Figure 5:
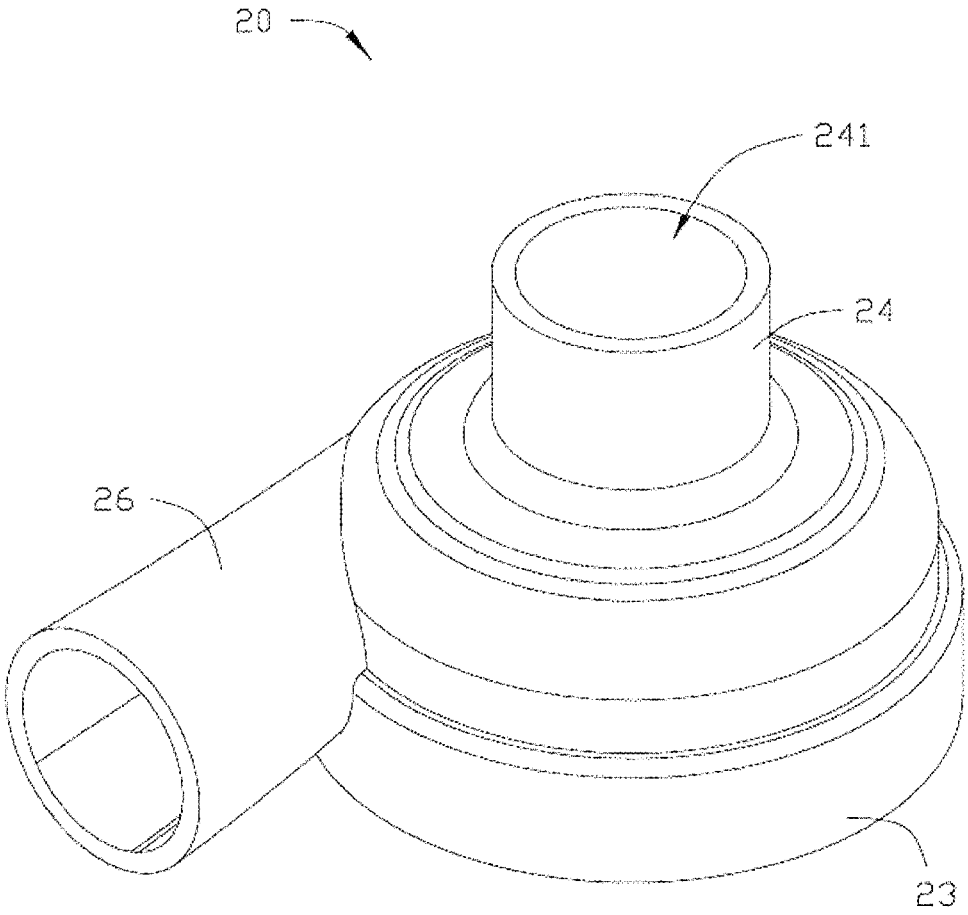
FIG. 5 is a perspective view of a volute housing of FIG. 1.

The volute housing 20 includes a housing body 23, an inlet pipe 24, and outlet pipe 26 (see FIG. 5), and a baffle portion 25. In this embodiment, the inlet pipe 24 is disposed at one side of the housing body 23, and the outlet pipe 26 is disposed at the other side of the housing body 23. The baffle portion 25 is disposed at one side of the housing body 23 adjacent the inlet pipe 24. In this embodiment, the housing body 23 and the baffle portion 25 are integrally formed. In another embodiment, the housing body 23 and the baffle portion 25 may also be separate components that are assembled together.

The housing body 23 includes a diffusor chamber 232 with an open end. The open end of the diffusor chamber 232 is connected to the driving device 30. The diffusor chamber 232 allows the impeller 50 to be rotatably received therein.

In this embodiment, the inlet pipe 24 is substantially hollow tubular, which is disposed on one side of the housing body 23 away from the open end of the diffusor chamber 232, with a central axis of the inlet pipe 24 substantially parallel to or coincident with a central axis of the diffusor chamber 232. The inlet pipe 24 defines a flow passage 241 along its central axis. The flow passage 241 communicates with the diffusor chamber 232.

In this embodiment, the baffle portion 25 is generally an annular projection which projects from an end wall (not labeled) in the diffusor chamber 232 adjacent the inlet pipe 24. Preferably, a central axis of the baffle portion 25 is coincident with the central axis of the inlet pipe 24. An annular engagement groove 251 is formed in and along a circumferential direction of one end of the baffle portion 25 away from the inlet pipe 24. The engagement groove 251 is used to receive the impeller 50.

The outlet pipe 26 is disposed on the housing body 23. The outlet pipe 26 is in fluid communication with the diffusor chamber 232, such that the inlet pipe 24, the diffusor chamber 232, and the outlet pipe 26 collectively form a channel for flowing of the fluid such as water, oil or gas. When the driving device 30 drives the impeller 50 to rotate, the fluid can enter the diffusor chamber 232 via the inlet pipe 24 and be discharged out of the diffusor chamber 232 via the outlet pipe 26.

In this embodiment, the pump 100 is preferably a unidirectional rotary pump, and the driving device 30 is preferably powered by a unidirectional rotary motor. The driving device 30 includes a support member 31 for mounting of the rotary motor and being connected to the volute housing 20, and a driving shaft 32. The driving device 30 drives the impeller 50 to rotate through the driving shaft 32. In particular, one end of the driving shaft 32 extends into the diffusor chamber 232 of the volute housing 23 and is connected to the impeller 50 such that the impeller 50 can be rotated synchronously with the driving shaft 32.

Figure 2:
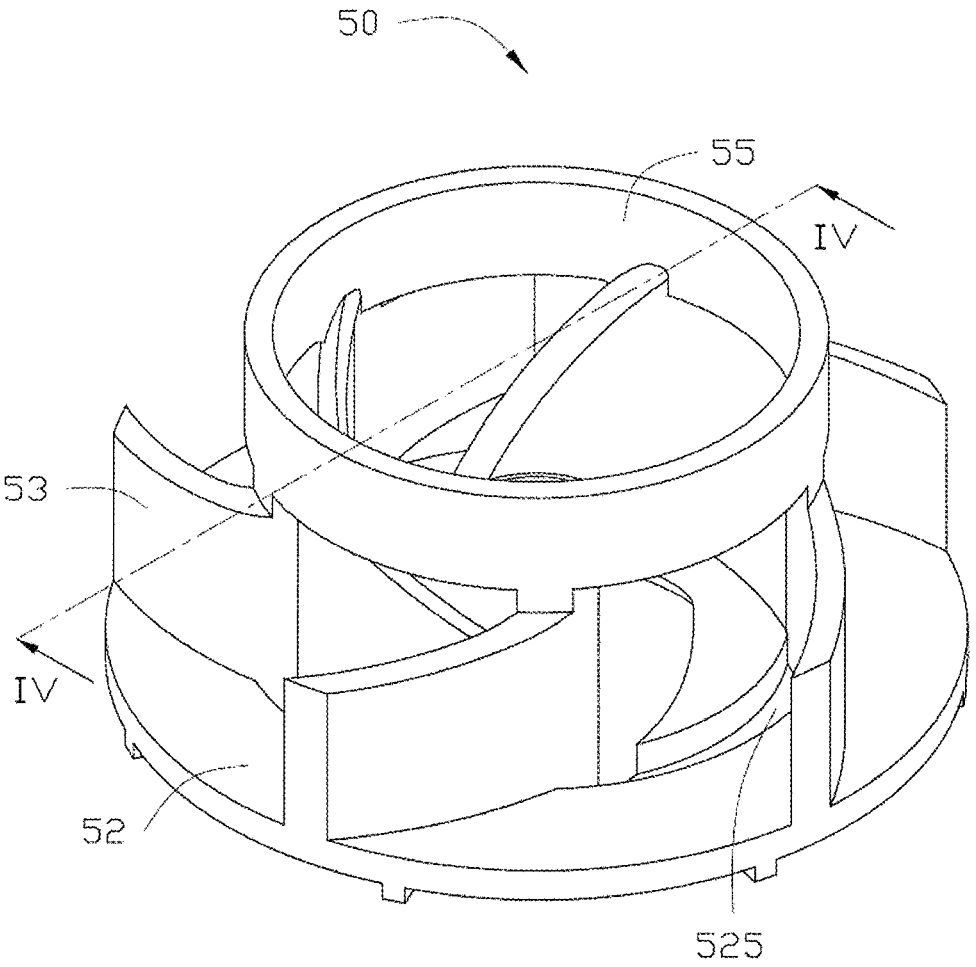
FIG. 2 is a perspective view of an impeller according to one embodiment of the present invention.
Figure 3:
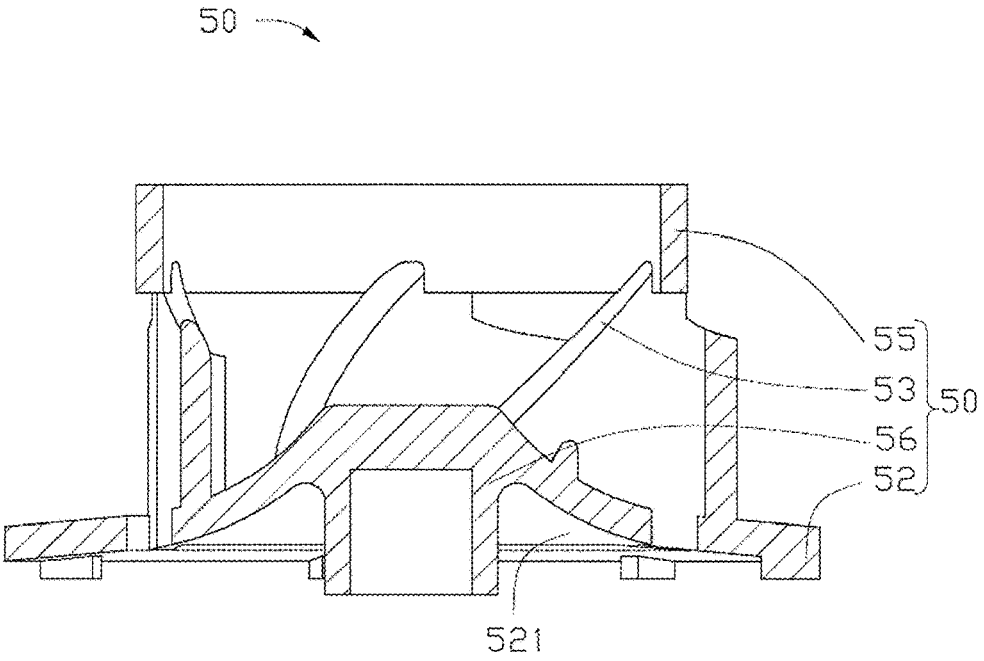
FIG. 3 is a perspective view of the impeller of FIG. 2, viewed from another aspect.

Referring to FIG. 1 to FIG. 3, the impeller 50 is mounted on the driving shaft 32 and received in the diffusor chamber 232. The impeller 50 includes a back cover plate 52, a plurality of vanes 53, a sealing ring 55, and a hub 56. In this embodiment, the plurality of vanes 53 is disposed on one side of the back cover plate 52. The sealing ring 55 is disposed at one side of the plurality of vanes 53 away from the back cover plate 52. The hub 56 is disposed at a central area of the back cover plate 52.

In this embodiment, the back cover plate 52 is substantially circular disc-shaped, a center of which is recessed toward one side to form a recess 521 at the center area of the back cover plate 52. The recess 521 is used to receive the hub 56 such that an axial size of the impeller 50 is reduced, which facilitates miniaturization of the impeller 50. The back cover plate 52 further defines balance holes. In this embodiment, the balance holes 525 are through holes passing through the back cover plate 52, and the number of the balance holes 525 is the same as the number of the vanes 53. In this embodiment, each of the balance holes 525 is arc strip-shaped, and the arcs of all the balance holes 525 collectively form a circle concentric with the hub 56. The balance holes 525 of the back cover plate 52 can balance the flow pressure on opposite sides of the back cover plate 52, reduce the axial force applied on the impeller 50, maintain rotation stability of the impeller 50, and can thus reduce the operational vibration of the pump 100 and ensure the operation efficiency of the pump 100.

In this embodiment, the number of the balance holes 525 and the number of the vanes 535 are both five. The balance holes 525 are arranged into a ring in the back cover plate 52. In addition, each balance hole 525 is substantially arc-shaped, and one end of each vane 53 is disposed between two adjacent balance holes 525. A central axis of the ring cooperatively defined by the balance holes 525 is coincident with the central axis of the back cover plate 52.

The vanes 53 are uniformly distributed on one side of the back cover plate 52 and extend from start positions adjacent the central axis of the back cover plate 52. In this embodiment, the vanes 53 are curved vanes, which radiate curvedly from the start positions adjacent the central axis of the back cover plate 52 toward an edge of the back cover plate 52 and terminating at the edge of the back cover plate 52. Each vane 53 is perpendicular to the back cover plate 52.

In this embodiment, the sealing ring 55 is an annular structure. One side of the sealing ring 55 is connected to one side of the vanes 53 away from the back cover plate 52, and the other side of the sealing ring 55 is rotatably received in the engagement groove 251. The hub 56 is disposed on one side of the back cover plate 52 away from the impeller 53. The hub 56 is fixedly attached around on one end of the driving shaft 32, or movably connected with one end of the driving shaft 32 in a spline-connection manner such that the impeller 50 can be rotated synchronously with the driving shaft 32.

Referring to FIG. 4, the back cover plate 52 includes a connecting plate 522 and a support plate 524. In this embodiment, the connecting plate 522 is round, the support plate 524 is annular, and an inner diameter of the connecting plate 522 is greater than an outer diameter of the support plate 524. The connecting plate 522 is attached around and spaced from the support plate 524. The hub 56 is disposed on one side of the support plate 524 away from the vanes 53.

Each vane 53 includes a main portion 531 and a connecting portion 532. One end of the main portion 531 is connected to the sealing ring 55, and the other end is connected to the connecting plate 522 and support plate 524 of the back cover plate 52. In this embodiment, a generally central area of one end of the main portion 531 away from the sealing ring 55 protrudes to form the connecting portion 532. The connecting portion 532 is connected between the connecting plate 522 and the support plate 524 of the back cover plate 52 to divide a spacing (not labeled) between the connecting plate 522 and the support plate 524 into the plurality of the balance holes 525.

Figure 6:
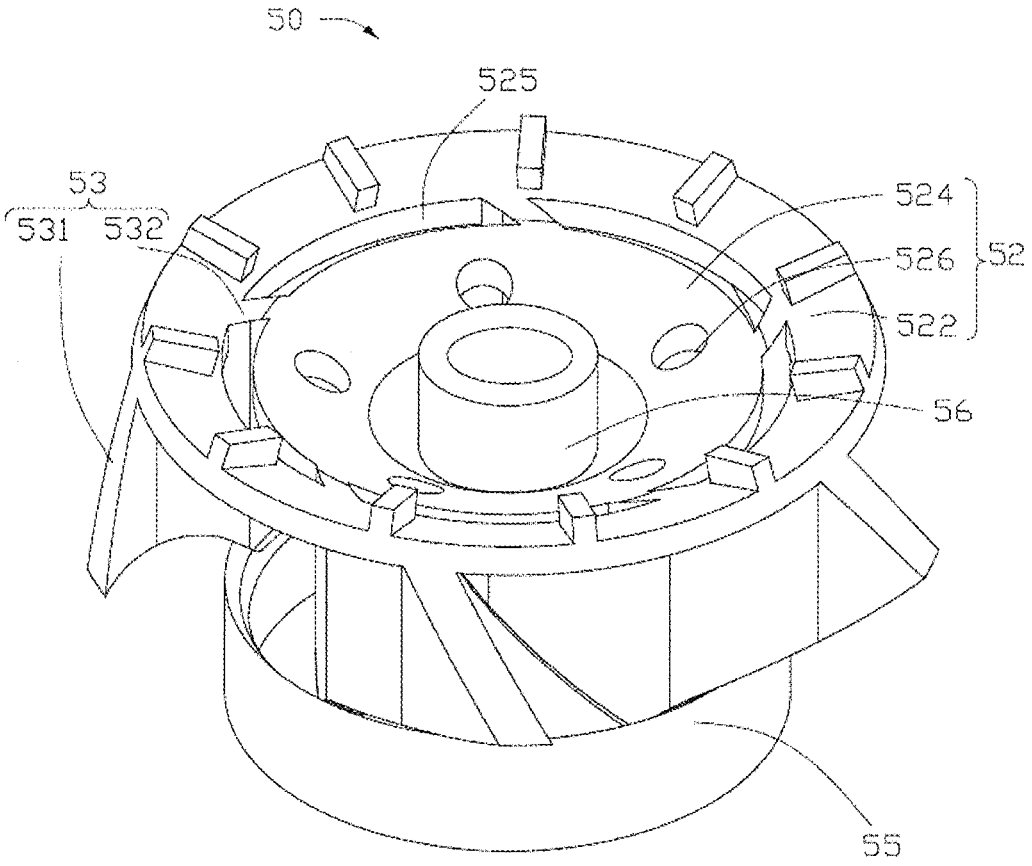
FIG. 6 is a perspective view of an impeller according to another embodiment of the present invention.

Referring to FIG. 6, it should be understood that, in another embodiment of the present invention, in order to further reduce the axial force applied to the impeller 50, the support plate 524 forms a plurality of through holes 526 that are evenly spaced and arranged into a ring. The through holes 526 cooperatively define a circle that is concentric with the hub 56.

Referring again to FIG. 1, in assembly of the pump 100 of this embodiment, the impeller 50 is first mounted to the driving shaft 32 of the driving device 30. The end of the housing body 23 that defines the diffusor chamber 232 is then connected with the support member 31 of the driving device 30, with the impeller 50 received in the diffusor chamber 232 and the sealing ring 55 received in the engagement groove 251.

Referring to FIG. 6, it should be understood that the vane 53 may be inclined at an angle to the back cover plate 52. The inclination direction and inclination angle of each vane 53 relative to the back cover plate 52 may be the same.

It should be understood that the vanes 50 of the present invention may be integrally formed, or alternatively, one or some of the back cover plate 52, vanes 53, sealing ring 55 and hub 56 may be separately formed and then assembled through welding, gluing or mortise-tenon connection.

In the pump 100 of the present invention, the impeller 50 is provided with the sealing ring 55, and the volute housing 20 is provided with the engagement groove 251 that receives the sealing ring 55. This changes the way the fluid flows in the diffusor chamber 232 of the volute housing 20 and increases the resistance to the fluid flowing back into the inlet pipe 24, thereby further optimizing the design of the volute housing 20 and resulting in enhanced fluid delivery efficiency. In addition, the back cover plate 52 of the impeller 50 is provided with the plurality of arc strip-shaped balance holes 525, which reduces the axial force applied to the impeller 50 and results in more stable rotation of the impeller 50.

Although the invention is described with reference to one or more embodiments, the above description of the embodiments is used only to enable people skilled in the art to practice or use the invention. It should be appreciated by those skilled in the art that various modifications are possible without departing from the spirit or scope of the present invention. The embodiments illustrated herein should not be interpreted as limits to the present invention, and the scope of the invention is to be determined by reference to the claims that follow.

The invention claimed is:

1. An impeller comprising:

a back cover plate, a plurality of vanes disposed on the back cover plate;

a hub disposed on the back cover plate; and a sealing ring connected to each of the vanes and disposed on ends of the vanes away from the back cover plate;

wherein the back cover plate further defines a plurality of balance holes;

wherein the number of the balance holes is equal to the number of the vanes;

wherein the plurality of balance holes is arranged into a ring in the back cover plate, and each of the vanes is disposed between two adjacent balance holes;

wherein the back cover plate further defines a plurality of through holes arranged into a ring, and the plurality of through holes are spaced from each other and evenly distributed in an annular area cooperatively bounded by the balance holes and the hub.

2. The impeller of claim 1, wherein the back cover plate defines a recess in one side of the back cover plate, and the hub is disposed in the recess of the back cover plate.

3. The impeller of claim 1, wherein each of the balance holes is arc-shaped, and a central axis of the ring cooperatively defined by the balance holes is coincident with a central axis of the back cover plate.

4. The impeller of claim 1, wherein the vanes extend from start positions adjacent a central axis of the back cover plate toward an edge of the back cover plate.

5. The impeller of claim 1, wherein the back cover plate comprises a connecting plate and a support plate, one side of each of the vanes away from the sealing ring is connected to the connecting plate and the support plate, and the hub is disposed on one side of the support plate away from the vanes.

6. The impeller of claim 5, wherein the connecting plate is annular, the support plate is annular, and the connecting plate surrounds the support plate.

7. The impeller of claim 5, wherein each of the vanes includes a main portion, one end of the main portion is connected to the sealing ring, and the other end is connected to the connecting plate and the support plate.

8. The impeller of claim 7, wherein each of the vanes includes a connecting portion projecting from one end of the main portion, and the connecting portion is connected between the connecting plate and the support plate to divide a spacing between the connecting plate and the support plate into a plurality of balance holes.

9. The impeller of claim 5, wherein the support plate defines a plurality of through holes arranged into a ring, which is concentric with the hub.

10. A pump comprising:

a volute housing comprising a housing body, an inlet pipe and an outlet pipe, the housing body defining a diffusor chamber, the inlet pipe and the outlet pipe being in communication with the diffusor chamber;

a driving device connected to the housing body; and an impeller rotatably received in the housing body and connected to the driving device so as to be driven by the driving device to rotate, the impeller comprising:

a back cover plate, a plurality of vanes disposed on the back cover plate;

a hub disposed on the back cover plate; and a sealing ring connected to each of the vanes and disposed on ends of the vanes away from the back cover plate;

wherein the back cover plate further defines a plurality of balance holes;

wherein the number of the balance holes is equal to the number of the vanes;

wherein the plurality of balance holes is arranged into a ring in the back cover plate, and each of the vanes is disposed between two adjacent balance holes;

wherein the back cover plate further defines a plurality of through holes arranged into a ring, and the plurality of through holes are spaced from each other and evenly distributed in an annular area cooperatively bounded by the balance holes and the hub.

11. The pump of claim 10, wherein the pump further comprises a baffle portion disposed on an end wall in the diffusor chamber adjacent the inlet pipe, and the baffle portion engages with the sealing ring of the impeller to prevent back flow of the fluid.

12. The pump of claim 11, wherein one end of the baffle portion defines an annular engagement groove therein along a circumferential direction of the end, and the sealing ring is rotatably received in the engagement groove.

* * * * *